United States Patent [19]

Gunnell, III

[11] 4,237,755

[45] Dec. 9, 1980

[54] PIPE FLANGE TOOL

[76] Inventor: Carl F. Gunnell, III, 2965 Wilson Ave., Oakton, Va. 22124

[21] Appl. No.: 967,151

[22] Filed: Dec. 6, 1978

[51] Int. Cl.[3] ..... B25B 13/02

[52] U.S. Cl. ..... 81/90 C

[58] Field of Search ..... 81/71, 90 R, 90 C

[56] References Cited

U.S. PATENT DOCUMENTS

| | | | |
|---|---|---|---|
| 2,480,565 | 8/1949 | Franks et al. | 81/90 C X |
| 3,043,171 | 7/1962 | Lederer | 81/90 C |
| 4,027,572 | 6/1977 | Burge | 81/90 C X |

FOREIGN PATENT DOCUMENTS

| | | | |
|---|---|---|---|
| 835536 | 9/1938 | France | 81/90 C |

*Primary Examiner*—James G. Smith

*Attorney, Agent, or Firm*—Breneman, Kane & Georges

[57] ABSTRACT

The pipe flange tool for tightening or removing threaded pipe flanges which includes a base having at least three engaging pins laterally extending from one side of the base and means for rotationally engaging the base. The engaging pins are positioned on the base such that at least two of the pins cooperate to tighten or remove various threaded pipe flanges as are commonly used for forming circulating pumps to pipes. The tool base may be provided with a bore in the base itself or have a laterally extending hub having a bore sized to receive a conventional socket wrench. The base may also be provided with pins having various configurations including cylindrical or frusto-conical.

9 Claims, 6 Drawing Figures

PIPE FLANGE TOOL

BACKGROUND OF THE INVENTION

1. Field of the Invention

The present invention relates to pipe flange tools used by plumbers and other mechanics to tighten or remove threaded flanges from pipes and assorted pipe fittings. More particularly, the invention pertains to an improved pipe flange tool having a base and at least three pins disposed thereon so that in operation at least two pins cooperate in tightening or removing pipe flange fittings. The invention further provides a simple and an inexpensively producted tool that can be conveniently activated by means of a conventional socket wrench.

2. Description of the Prior Art

The prior art includes a variety of patents pertaining to pump flange tools which seek to provide for the construction of an efficient and economically manufactured pipe flange tool as represented by U.S. Pat. Nos. 1,681,126; 3,498,160; 3,731,560; 3,073,206; and 4,059,033. For example, U.S. Pat. No. 1,681,126 (McDonnell-Pipe Flange Tool) illustrates a solid circular hub having holes therein together with a bar having slots provided therein for receiving adjustable bolts. Once the bolts are set in place, the assembled tool can engage the bolt holes of the pipe flange to be tightened or removed. U.S. Pat. No. 3,498,160 (Brockway-Flange Fightener) depicts a conventional pipe wrench to engage a square-shaped bar containing a ratchet assembly with engaging pins provided thereon. As in McDonnell, the bar is provided with three sets of holes for receiving bolts for adjustable engagement of corresponding holes of a pipe flange. Other patents such as U.S. Pat. No. 3,731,560 (Bares-Adjustable Spanner Wrench) illustrate spanner-type tools having two heads containing revolving disks having pins disposed thereon that may be adjusted with respect to one another for engaging workpieces having receiving holes therein.

The present invention may be distinguished from such prior art pipe flange tools in two significant respects. First, the present tool, unlike the prior art, may be used without any manual adjustment or other modification of the tool prior to tightening or removing pump flanges. It has been discovered in accordance with the invention that the pump flanges in use utilize two pump flange sizes that are accommodated by the tool of the present invention. Second, inasmuch as the invention may be implemented without the use of separable or moving parts, it is far simpler in construction, more economical to manufacture, and considerably more convenient to use and store.

SUMMARY OF THE INVENTION

The disadvantages and limitations of prior art pipe flange tools are obviated by the present pipe flange tool which includes a base having at least three engaging pins laterally extending from a side of the base. The base also has a means for rotationally engaging the tool with an angle wrench having at least three sides. In operation the pins cooperate in such a manner that a set of two of the three pins are utilized to engage two of the pipe flange attachment holes of one size pipe flange and another set of two pins are utilized to engage two of the pipe flange attachment holes of a second size pipe flange. In the course of investigation leading to the present invention it was discovered that pipe flanges in general home and residential use are accommodated by the tool of the invention and represent such manufacturers as B&G, Thrush, Taco, Grumdfas, Sears and other pump manufacturers.

The base of the pump flange tool further includes means for rotationally engaging the base of the pump flange tool with a wrench. It will of course be recognized by those skilled in the art that the means for engagement may be either an angled hole in the base such as a three or more sided hole for the engagement of a wrench or include a laterally extending hub having a square-shaped bore sized to receive a conventional socket wrench. In either embodiment, the point of rotational engagement is preferably positioned on the base so as to provide the best possible mechanical advantage to the operator.

As will be recognized by those skilled in the art the best mechanical advantage is provided where the point of rotational engagement is provided at or near the center of the pipe flange being removed. Consequently in the preferred embodiment of the invention the point of rotational attachment of the base is provided at or near the center of the triangular area defined by lines defining the distance between two sets of pins for engaging the two sized pump flanges as heretofore described.

The engaging pins are positioned on the base such that the tool may be used without modification to tighten or remove the residential sized threaded pipe flanges as heretofore described. In the application of the present tool only two of the pins cooperate to engage either of two standard-sized flanges. Thus, a common pin is paired with each remaining pin, depending on the size of the flange to be tightened or removed. The spacing between the center of the common pin and the centers of the remaining pins is equal to the spacing between the centers of diametrically-opposite bolt holes in the standard sized threaded pipe flanges.

For example, in order to tighten a standard one-inch NPT flange, the base is attached to the flange such that the two pins having a center-to-center spacing of in the range of about $2\frac{3}{4}$ to 3-7/16 inches and preferably 3 3/16 inches are inserted into the diametrically-opposite holes in the one-inch pipe flange. The remaining pin is positioned on the bar such that it remains outside the perimeter of the flange to be tightened. An angle wrench having at least three sides is then inserted into a bore in the side of the base opposite the engaging pins and the wrench is operated such that the flange rotates in a clockwise direction.

In order to tighten a standard $1\frac{1}{4}$ inch NPT flange, the two pins having a spacing of about 3 to 3-14/16 inches and preferably 3-7/16 inches are inserted into the two corresponding flange bolt holes. Again, once the pipe flange tool is in place, the remaining unused pin is positioned on the base such that it remains outside the perimeter of the $1\frac{1}{4}$ inch flange.

The advantage of the present invention is that it may be used on presently available standard-size nonindustrial threaded pipe flanges without requiring manual adjustment or modification of the pins which insert into the flange bolt holes. Moreover, as a consequence of its one-piece design and construction, the invention is far less expensive to manufacture, easier to store, and provides a considerably more reliable tool for use in plumbing and other harsh applications.

DESCRIPTION OF THE DRAWINGS

Other advantages of the invention will become apparent to those skilled in the art from the following detailed description of the invention in conjunction with the appended drawings in which.

DETAILED DESCRIPTION OF THE INVENTION

Figure 1:
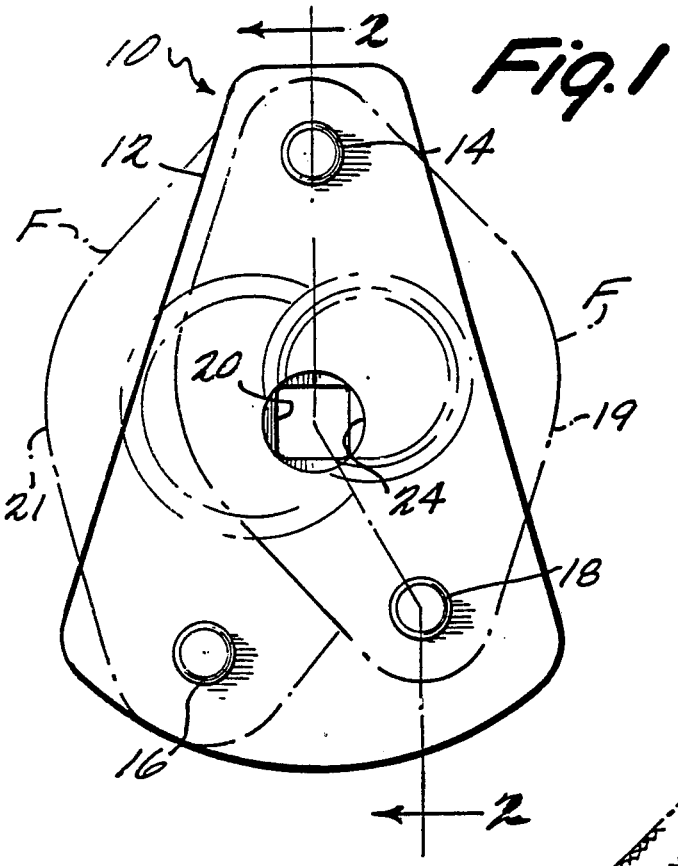
FIG. 1 is a front elevation of operative embodiments of the pipe flange tool illustrating in phantom the engagement of two pipe flanges.

Referring now to FIG. 1, the novel pipe flange tool 10 includes base 12 having three laterally-extended cylindrical engaging pins 14, 16 and 18 disposed on one side of the base.

A means for rotationally engaging base 12 is provided in the base as a four sided opening 20 of a thickness 24 which is equal to the thickness of base 12. One of the standard size pipe flanges 19 is illustrated in phantom as operatively engaged by pins 14 and 18 while a second standard sized pipe flange 21 is also operatively illustrated in phantom as operatively engaged by pins 14 and 16. As will be recognized by those skilled in the art only one flange is engaged at one time in the removal of flanges.

The disposition of the pins can of course be arranged in a variety of ways by those skilled in the art. More particularly, the distance between pins 16 and 18 may be modified while still achieving the advantages of the invention. The disposition of opening 20 should however be disposed at or near the center of a triangle formed by pins 14, 16 and 18.

Figure 2:
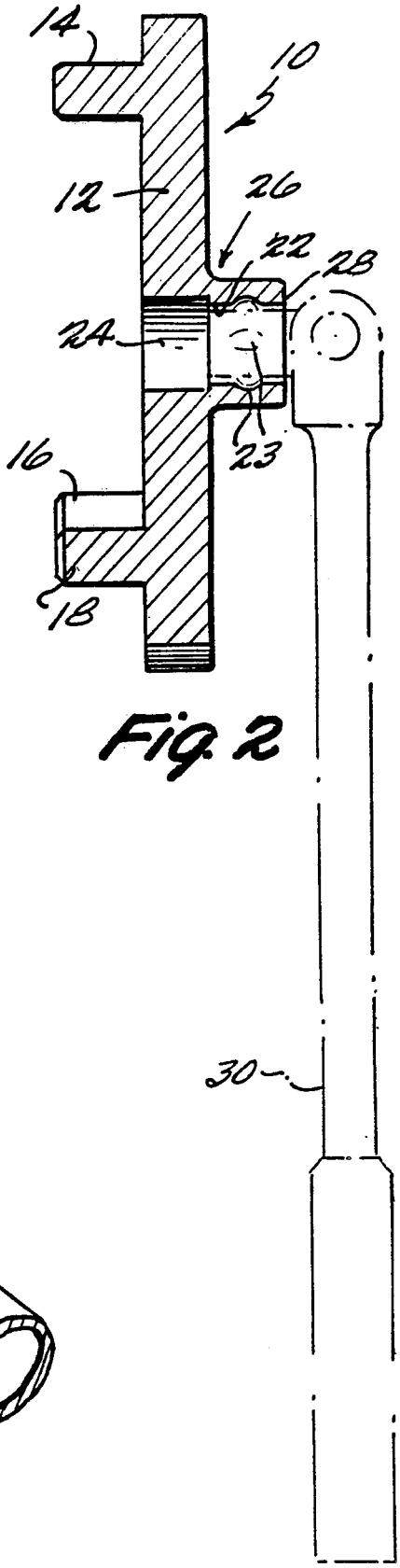
FIG. 2 is a vertical sectional view taken on line 2—2 of FIG. 1, illustrating a modified hub and the tool as operated by a conventional socket wrench.

Referring now to FIG. 2, the novel tool 10 illustrates the engaging pins extended from one side of the base together with a laterally extended cylindrical hub 26 affixed to the side of the base, opposite the engaging pins and extending beyond the thickness 24 of base 12. The cylindrical hub 26 includes a square-shaped bore 28 sized to receive a conventional socket wrench 30. In this embodiment of the tool, the center portion 23 of hub 26 and each of the four faces of socket bore 22 are slightly recessed in order to receive the locking pin 23 on the driver member of the socket wrench 30.

Figure 3:
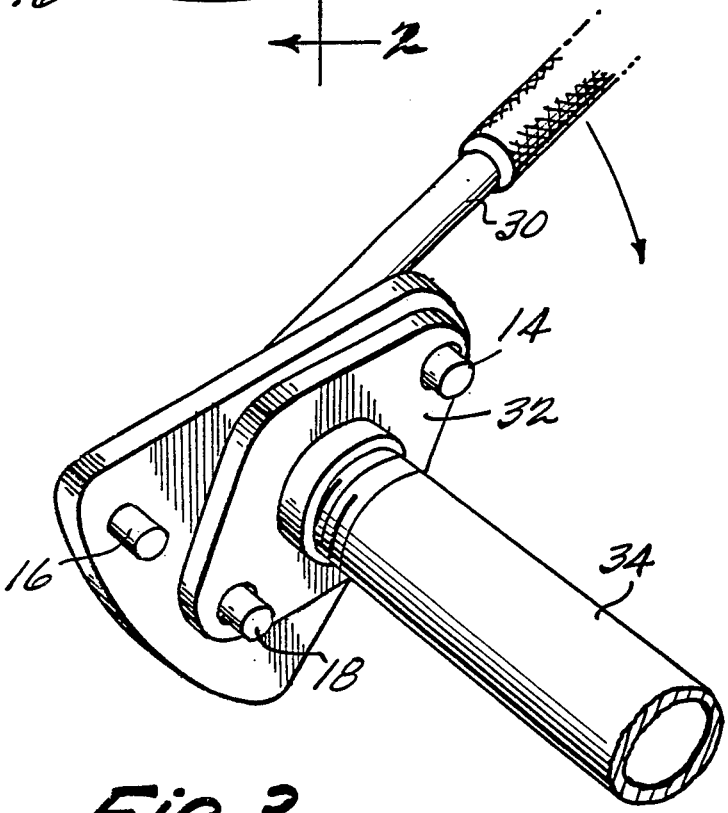
FIG. 3 is a diagramatic view of the pins disposed in a standard-size threaded pipe flange.

In FIG. 3, the novel tool 10 is depicted with two of the three pins i.e., pins 14 and 18 engaged to a standard-size threaded pipe flange 32 which in turn is threaded onto pipe 34. FIG. 3 further illustrates the mechanical advantage available when the novel tool 10 is utilized in conjunction with a wrench 30 which preferably is of the ratchetable type.

Figure 4:
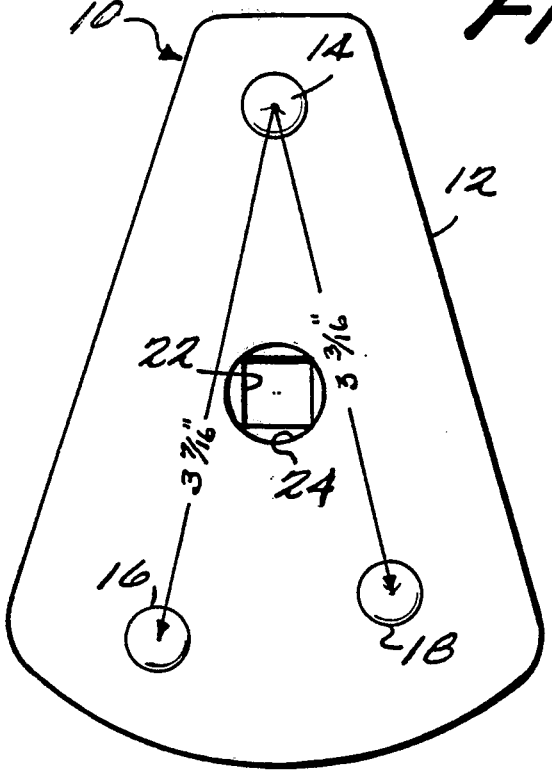
FIG. 4 is a front elevation of the tool showing the center-to-center spacings of the engaging pins for the standard-sized threaded pipe flanges.

Referring now to FIG. 4, the novel tool 10 is illustrated with the preferred distance between the centers of pins 14 and 18 being about 3-3/16 inches and the distance between the centers of pins 14 and 16 being about 3-7/16 of an inch. It will be recognized that the distance between the centers of pins 14 and 18 may be in the range of about 2¾ to 3-7/16 inches and that the distance between the centers of pins 14 and 16 may be in the range of about 3 to 3-14/16 inches.

Figure 5:
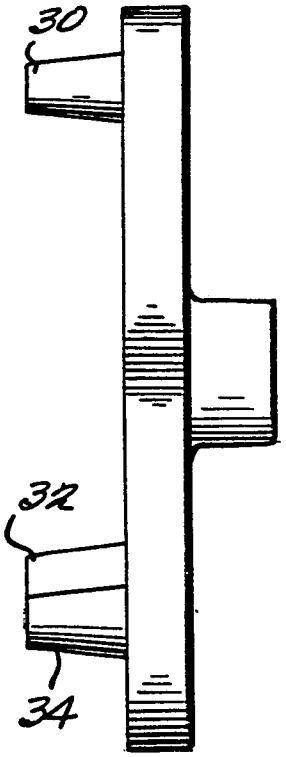
FIG. 5 is a side elevation of the tool illustrating an alternative embodiment of the engaging pins.

FIG. 5 illustrates a further embodiment of the invention wherein pins 30, 32 and 34 are of a frustro conical configuration. It will be recognized that the pins may be of other configurations including a stepped conical configuration to assist in the engagement and maintaining of the pins in the bolt holes of the flanges.

Figure 6:
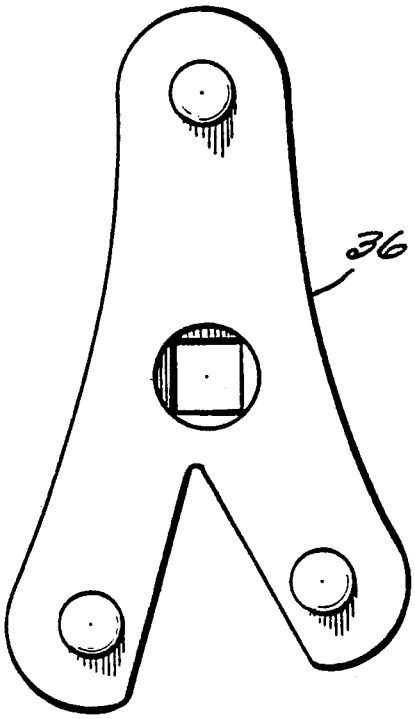
FIG. 6 is a front elevation of the tool showing an alternative embodiment of the invention.

Referring to FIG. 6 a further embodiment of the maintenance of the invention is illustrated wherein a modified base 36 is provided having a Y-shaped configuration. It will be recognized by those skilled in the art in conjunction with the present disclosure that a variety of modified bases may be constructed utilizing the present invention.

It will be further recognized that the advantages incumbent in the invention such as efficiency of use and ease of manufacture of tools constructed in accordance with the invention may be implemented in a variety of ways by those skilled in the art. It will be understood that a rachetable socket assembly may be included with the base and that the configuration of the base and arrangement of the pins may be modified to suit a variety of manufacturing and operational design applications for use in the field.

These and other modifications and other applications of the present invention may be made within the spirit and scope of the invention as defined in the appended claims.

What is claimed is:

1. A pipe flange tool for tightening or removing threaded pipe flanges comprising:

(a) a base;

(b) at least three spaced engaging pins affixed to said base wherein the distance from the centers of a first set of two pins is in the range of about 2¾ to 3-7/16 inches and the distance from the centers of a second set of two pins is in the range of about 3 to 3-14/16 inches; and (c) means provided in said base for rotational engagement of said base with a wrench.

2. The pipe flange tool for tightening or removing threaded pipe flanges of claim 1 wherein said at least three spaced engaging pins are disposed on said base in a triangular arrangement.

3. The pipe flange tool for tightening or removing threaded pipe flanges of claim 1 wherein the distance from the center of a first set of said pins is about 3-3/16 inches and the distance from the centers of a second set of two pins is about 3-7/16 inches.

4. The pipe flange tool for tightening or removing threaded pipe flanges of claim 1 wherein said means provided in said base for rotational engagement is an angled hole in said base for engaging a wrench having at least three sides.

5. The flange tool for tightening or removing threaded pipe flanges of claim 4 wherein said means provided in said base for rotational engagement is a four-sided hole in said base for engaging a conventional socket wrench.

6. The pipe flange tool for tightening or removing threaded pipe flanges of claim 4 wherein said means provided in said base is between the area defined by a line defining the distance between said first and said second pair of pins.

7. The pipe flange tool for tightening or removing threaded pipe flanges of claim 1 wherein said pins are of a frustro-conical configuration.

8. The pipe flange tool for tightening or removing threaded pipe flanges of claim 1 wherein said means provided in said base for rotational engagement is a laterally extending hub affixed to said base.

9. The pipe flange tool for tightening or removing threaded pipe flanges of claim 8 wherein said laterally extending hub includes a square shaped bore for receiving a conventional socket wrench.

* * * * *